US007975751B2

(12) United States Patent
Gosch et al.

(10) Patent No.: US 7,975,751 B2
(45) Date of Patent: Jul. 12, 2011

(54) PERMANENT CASTING MOULD AND CASTING MOULD INSERT

(75) Inventors: Rolf Gosch, Thalheim (AT); Peter Stika, Linz (AT)

(73) Assignee: Nemak Linz GmbH, Linz (AT)

( * ) Notice: Subject to any disclaimer, the term of this patent is extended or adjusted under 35 U.S.C. 154(b) by 350 days.

(21) Appl. No.: 12/093,839

(22) PCT Filed: Aug. 7, 2006

(86) PCT No.: PCT/EP2006/065098

§ 371 (c)(1),
(2), (4) Date: Aug. 21, 2008

(87) PCT Pub. No.: WO2007/057238

PCT Pub. Date: May 24, 2007

(65) Prior Publication Data

US 2008/0296471 A1 Dec. 4, 2008

(30) Foreign Application Priority Data

Nov. 16, 2005 (DE) ..... 10 2005 054 616

(51) Int. Cl.
*B22C 9/06* (2006.01)

(52) U.S. Cl. ..... 164/342

(58) Field of Classification Search ..... 164/339, 164/340, 341, 342, 137

See application file for complete search history.

(56) References Cited

U.S. PATENT DOCUMENTS

| | | | | |
|---|---|---|---|---|
| 4,362,686 | A * | 12/1982 | Clishem et al. | 264/317 |
| 5,615,726 | A * | 4/1997 | Ota et al. | 164/32 |
| 6,761,208 | B2 * | 7/2004 | Whealy et al. | 164/340 |
| 2003/0173699 | A1 * | 9/2003 | McLean | 264/154 |
| 2005/0238751 | A1 * | 10/2005 | Braungardt et al. | 425/431 |
| 2010/0096777 | A1 * | 4/2010 | Appleby et al. | 264/318 |

FOREIGN PATENT DOCUMENTS

| | | | |
|---|---|---|---|
| DE | 43 13 336 | A1 | 10/1994 |
| DE | 198 38 561 | A1 | 3/2000 |
| DE | 100 59 045 | C1 | 2/2002 |

OTHER PUBLICATIONS

International Search Report for PCT/EP2006/065098 mailed Jul. 17, 2008.

* cited by examiner

*Primary Examiner* — Kevin P Kerns
(74) *Attorney, Agent, or Firm* — Proskauer Rose LLP

(57) ABSTRACT

A permanent casting mould for casting cast parts, in particular cylinder heads, from a molten metal, in particular a molten light metal, includes at least one mould body, which at least partially surrounds a mould cavity reproducing the cast part to be cast and, in the wall of which limiting the mould cavity, a receiver is formed having a shoulder passing into the mould cavity and including a casting mould insert seated in the receiver, which has an upper side associated with the mould cavity surrounded by the respective permanent casting mould, a base body seated in the receiver with play when the casting mould is cold and a support collar which extends over a fraction of the height of the base body of the casting mould insert and is seated with positive fit in the shoulder of the receiver.

11 Claims, 2 Drawing Sheets

PERMANENT CASTING MOULD AND CASTING MOULD INSERT

CROSS-REFERENCE TO RELATED APPLICATIONS

Figure 1:
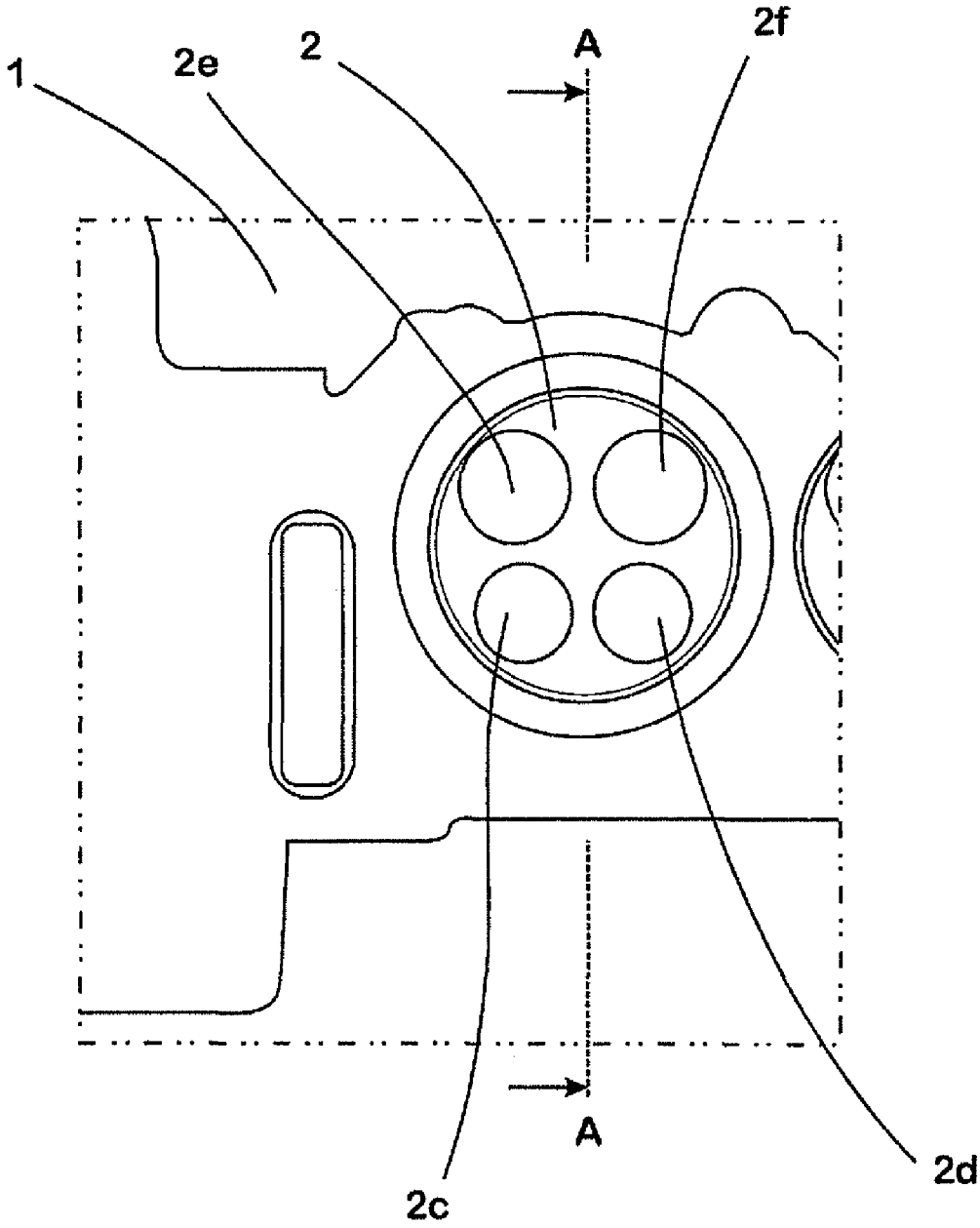

This application is a National Phase Application of International Application No. PCT/EP2006/065098, filed on Aug. 7, 2006, which claims the benefit of and priority to German patent application no. DE 10 2005 054 616.1-24, filed Nov. 16, 2005. The disclosure of each of the above applications is incorporated herein by reference in their entirety.

FIELD OF THE INVENTION

The invention relates to a permanent casting mould for casting cast parts from a molten metal, in particular a molten light metal, and a casting mould insert used in a permanent casting mould of this type. Permanent casting moulds of this type, also called "chill-moulds" in the technical terminology, are used, for example, in high volume production to cast cylinder heads for internal-combustion engines from an aluminium melt. The casting mould inserts in this case reproduce the combustion chambers in the cylinder heads. For this purpose, shaped elements, which form corresponding shaped elements in the cast part to be cast, are configured on their upper side associated with the mould cavity surrounded by the mould body.

BACKGROUND

Permanent casting moulds are generally multi-part and in each case comprise at least one mould body, which delimits, at least in sections, the mould cavity reproducing the cast part to be produced. In this case, the mould body is typically manufactured from a highly heat-resistant tool steel, which, despite the high mechanical and thermal stresses occurring during the casting operation, ensures an adequately long service life of the mould body.

Because of the high quality demands, (in respect of the contour accuracy of the cast products) the production of permanent casting moulds of the type in question is laborious and expensive. The aim is therefore to use permanent casting moulds for as long as possible and for as many parts as possible. This applies, in particular, to permanent casting moulds, which are used for high volume production of cylinder heads, as the production of such moulds is particularly intensive in terms of work and costs because of the complexity of shaping such cylinder heads.

In order to be able to vary certain shaped elements of the cast part to be produced, without having to produce a completely new casting mould for this purpose in each case, permanent casting moulds are generally equipped with casting mould inserts, which are inserted into the interior surrounded by the permanent casting mould and reproduce the respectively desired shaped elements, such as recesses or elevations in the cast part to be produced, in each case.

A typical example of the use of inserts of this type emerges in the production by casting of cylinder heads for internal-combustion engines already mentioned at the outset. The output yield, the combustion behaviour and the consumption of a combustion engine associated therewith is decisively influenced by the shape of the combustion chambers formed in each case in the cylinder head, into which the respective fuel is let via at least one inlet valve and from which the exhaust gases are expelled via at least one outlet valve.

In order to be able to modify the combustion chamber shape in a simple manner in a certain basic type of cylinder head, permanent mould inserts are generally inserted in the permanent casting mould provided for casting this cylinder head, the surface of which inserts associated with the mould cavity surrounded by the mould determines the shape of the combustion chamber recesses to be produced in each case in the cylinder head. Casting mould inserts of this type are also designated "combustion chamber inserts" in the technical language. For this purpose, they are seated in the receivers formed in the walls of the mould body delimiting the mould cavity.

During the casting process, because of the contact of the casting mould with the molten metal cast in each case, strong heating of the respective mould body and the casting mould inserts seated therein occurs. Because of this heating, the mould body and casting mould inserts expand. The extent of this expansion depends, on the one hand, on the temperature increase occurring in the mould body and casting mould insert, in each case, and, on the other hand, on the expansion behaviour of the material respectively used for the production thereof. Thus, there is generally a varying degree of expansion of the mould and casting mould insert, because the masses of the inserts and of the mould body are different, so the casting mould insert having a substantially lower mass heats up very much more quickly than the mould body surrounding it with the result that the insert expands more quickly and to a greater extent than the mould body surrounding it. This phenomenon does not only occur when the mould body and casting mould insert consist of different materials, but because of the lesser volumes, even when they are made from the same material.

The different expansion behaviour of the casting mould inserts and mould bodies leads to dimensional imprecisions, which prove to be particularly difficult to manage, for example, when casting is to take place so as to be as close as possible to final dimensions. This requirement proves to be particularly critical in the high volume manufacturing of cylinder heads, for which a maximum permissible dimensional variation of +/−0.15 mm relative to the desired dimension is required by the engine producer.

In order to ensure the reliable processing of the respectively required accuracy of the dimensional stability even under these conditions, complex measures for the installation of the casting mould inserts and a temperature distribution as uniform as possible in the mould body are required. Thus, in known permanent casting moulds used to cast cylinder heads, the position of the casting mould inserts in the respective mould body generally firstly has to be determined empirically by a large number of tests in order to compensate the heat expansion occurring during the respective casting process by a corresponding dimensioning of the casting form insert in such a way that an adequately precise casting result is achieved. If a suitable dimensioning is not possible in the framework of the installation space available in each case or with regard to the functioning and stability of the respective casting mould insert, cooling of the casting mould inserts may become necessary to reduce the heat expansion.

As, despite all the outlay effected to determine an optimal shape of the casting mould insert, unacceptable dimensional deviations frequently still occur in the casting operation when using conventional moulds, a check of the respectively completed heads for adherence to the required depth of the combustion chambers to be respectively formed in them generally has to be carried out in large volume manufacture by casting of cylinder heads, for example.

The attempt is known from DE 198 38 561 A1, to increase the service lives of moulds, in which non-iron metals, such as magnesium melts are cast into cast parts, in that the mould bodies and the casting mould inserts inserted therein are produced from a heavy metal material with a high melting point, such as molybdenum or tungsten. The advantage of using such materials for the production of casting moulds is seen in that they are attacked less by the respective molten light metal than conventional steels and are subject to accordingly lower corrosion.

Regardless of this advantage of the material selection proposed in DE 198 38 561 A1, the problem, however, exists that even the mould bodies manufactured from heavy metals with a high melting point and the casting mould inserts inserted therein expand to a different extent during heating because of their respective different volume and their faces of different sizes coming into contact with the melt. Thus, dimensional deviations caused by the different heat expansion are noticeable in practice even when heavy metal materials, which have particularly low coefficients of thermal expansion, are used according to the model of DE 198 38 561 A1.

SUMMARY OF THE INVENTION

Proceeding from the prior art described above, an aspect of the invention is to provide, with simple means, a casting mould insert and a permanent casting mould, which allow economical production of cast parts with improved production results compared to the prior art.

This aspect is achieved according to the invention with respect to a permanent casting mould for casting cast parts from a molten metal, in particular a molten light metal, in that a permanent casting mould of this type has a mould body which at least partially surrounds a mould cavity reproducing the cast part to be cast and, in the wall of which limiting the mould cavity, a receiver is formed having a shoulder passing into the mould cavity, and has a casting mould insert seated in the receiver, which has an upper side associated with the mould cavity surrounded by the respective permanent casting mould, a base body seated in the receiver with play when the casting mould is cold and a support collar which extends over a fraction of the height of the base body of the casting mould insert and is seated with positive fit in the shoulder of the receiver, the total height of the support collar and base body being smaller by an undersize, which is at least equal to the height dimension, by which the base body expands in the height direction during casting as a result of its heating occurring due to the contact with the molten metal, than the depth of the receiver, so a spacing is present between the base of the receiver and the side of the casting mould insert associated with it when the permanent casting mould is cold.

Accordingly, a casting mould insert, in particular a combustion chamber insert, for a permanent casting mould for casting cast parts from a molten metal, in particular a molten light metal, which has a base body and an upper side, which, when the casting mould insert is inserted into the permanent casting mould, is associated with the mould cavity delineated by the permanent casting mould and reproducing the mould part to be produced, has, according to the invention a support collar projecting relative to the base body, the height of which is less than the height of the casting mould insert.

The invention is based on the idea of supporting the casting mould insert in the permanent casting mould by a suitable constructional design such that, when it is heated, there is only a minimal change in the position of the upper side of the casting mould insert, associated with the mould chamber of the permanent casting mould. According to the invention, the casting mould insert, for this purpose, has a support collar, and a correspondingly shaped shoulder is formed in the receiver associated with it, in which the support collar is seated when the permanent casting mould is completely assembled. At the same time, the base body of the casting mould insert is dimensioned in such a way that it is positioned with play in the receiver associated with it when the casting mould is cold. In this manner, a space is configured between the base of the receiver and the lower side of the casting mould insert associated with it, the height of which space is adequate to receive the length by which the height of the casting mould insert base body changes during heating of the casting mould insert due to the contact with the molten metal. As a result of the expansion accompanying the heating, the casting mould insert is only pressed to a very small degree into the mould cavity surrounded by the casting mould, while the predominant amount of the expansion is taken up by the space available below the base body. In this manner, the expansions of the casting mould and casting mould insert occurring during the casting operation adapt to one another in such a way that despite the circumstance that the casting mould insert is subject to a lower outflow of heat and is consequently hotter and therefore expands more than the mould body surrounding the respective cast part, the expansions of the mould and insert actually occurring in the height direction are substantially the same or approximate one another to such an extent that they only differ from one another within a narrow tolerance range. At the same time, the base body may easily have a volume which is so great that the shaped elements configured on the casting mould insert are protected against excessive heating and the occurrence of excessive heat stresses in the surface region of the casting mould is avoided.

The invention thus allows cast parts, into which recesses are to be formed by means of casting mould inserts during casting operation to be produced with improved accuracy. Particularly good reproduction precisions are then achieved, in this case, when the support collar of the casting mould insert proceeds from the surface associated with the mould cavity of the permanent casting mould. Thus, in a simple manner, a flush connection of the surface of the casting mould insert to the surface of the mould body can be produced, which surrounds the receiver respectively associated with the casting mould insert.

The improvement in the manufacturing accuracy achieved in the manner according to the invention, proves to be particularly favourable in the production of cylinder heads for internal-combustion engines, which can be produced in a particularly cost-effective manner by a casting mould configured according to the invention. With the greater dimensional stability of a casting mould insert used as a combustion chamber insert, during heating, the dimensional stability of the combustion chamber reproduced by the relevant insert in the finished cylinder head also increases. Thus, the parameters required in the operation of the internal-combustion engine for the fuel compression and exhaust gas combustion can be adhered to more precisely.

A further advantageous application variant of the invention is the production of inlet channel core mark inserts in moulds for diesel cylinder heads. The fluctuations in the channel positions in the cylinder head can be reduced to a minimum by the precision in the reproduction of these shaped elements achieved according to the invention.

The position of the upper side of the casting mould insert that is important to the configuration of the cast part, in the configuration according to the invention, is only still dependent on how much the support collar changes in the height direction of the casting mould insert, as only the support collar in the height direction is supported directly on the mould body of the casting mould. The lower the height of the support collar, the smaller is the change of position of the upper side of the casting mould insert occurring during heating of the casting mould insert. On the other hand, there is adequate material available in the region of the base body to, on the one hand, configure the shaped elements required to shape the cast part and, on the other hand, to be able to remove heat from the cast part via an adequate material volume.

An advantageous configuration of the invention provides that the height of the support collar is at most 30% of the height of the base body of the casting mould insert. The aim here is to arrange the installation reference plane, in other words the plane, in which the support collar is supported on the mould body as close as possible to the free surface of the mould body directly associated with the mould cavity of the casting mould. It is accordingly favourable if the height of the support collar is at most 15% or even at most 10% of the height of the base body of the casting mould insert. Such a limitation of the height of the support collar can easily be produced in practice in that the casting mould insert and support collar merely hold the casting mould insert without being directly involved in the forming of shaped elements of the cast part to be manufactured.

The precision of the positioning of the casting mould insert in the width direction, in other words transverse to its height, can be ensured in that the support collar of the casting mould insert is seated without play in the shoulder of the receiver of the permanent casting mould associated with it. In this case, the fit between the support collar and the receiver can be such that the casting mould insert is also held securely in the receiver in the cold state, on the one hand, but, on the other hand, can also easily be removed therefrom.

Particularly secure support of the casting mould insert can be achieved in that the support collar surrounds the base body.

Because of the minimisation of the influence of the heat expansion of the casting mould insert achieved by the invention on the dimensional stability of the cast part to be produced, the invention basically allows the material used for the casting mould insert to be selected independently of its expansion behaviour during heating, purely by its suitability for forming the respectively desired shaped elements on the cast part. Practical tests have shown, however, that it is favourable, in particular with regard to optimising the cast structure in the region of the shaped element configured by the casting mould insert on the cast part if the casting mould insert is manufactured from a material, the thermal coefficient expansion of which is greater than that of the material of the mould body.

In conjunction with this it has proven to be particularly advantageous if the thermal coefficient of expansion of the casting mould insert is $17.0*10^{-6}$ m/(m*K) to $18.5*10^{-6}$ m/(m*K), in particular $17.5*10^{-6}$ m/(m*K) to $18.0*10^{-6}$ m/(m*K). In this respect, particularly well suited materials for the production of the casting mould inserts are Cu-based, Ni-based or Be-based alloys, wherein it may be advantageous if the casting mould insert in each case consists of 90% to 98% Cu, Ni or Be or alloys based on these elements.

A high coefficient of expansion of the casting mould insert proves to be particularly favourable when casting cast parts from molten light metals. In these, by using casting mould inserts with good heat conduction in the region of the shaped elements to be configured in each case by the casting mould insert, a particularly rapid cooling and, accompanying this, a particularly fine structure can be produced in a targeted manner, which has an advantageous effect on the mechanical properties. This possibility of targeted structure influencing has a particularly advantageous effect when casting cylinder heads, in which a favourable fine structure with regard to the permanent loadability can easily be produced with the invention in the region of the combustion chambers.

A further minimisation of the shape deviations occurring as a result of the heating during casting can additionally be achieved in that the combustion chamber inserts and/or the mould are cooled, in particular water-cooled, in a manner known per se.

Deformations of the casting mould insert as a result of the stresses occurring during its heating and prevention of the expansion of the casting mould insert in the height direction can also be counteracted in that the undersize of the cross-section of the base body relative to the cross-section of the receiver is at least equal to the expansion, which occurs as a result of the heating of the casting mould insert on contact with the molten metal in the width direction of the body.

The material of the mould body may, in particular, be a steel material, such as is already used successfully for this purpose in the prior art. The material of the mould is preferably selected according to the invention such that it has a thermal coefficient of expansion between $11*10^{-6}$ m/(m*K) and $12*10^{-6}$ m/(m*K). As the material for the mould body, in particular, a tool steel can be used, which has a high degree of hardness and toughness.

DETAILED DESCRIPTION OF FIGURES

Figure 2:
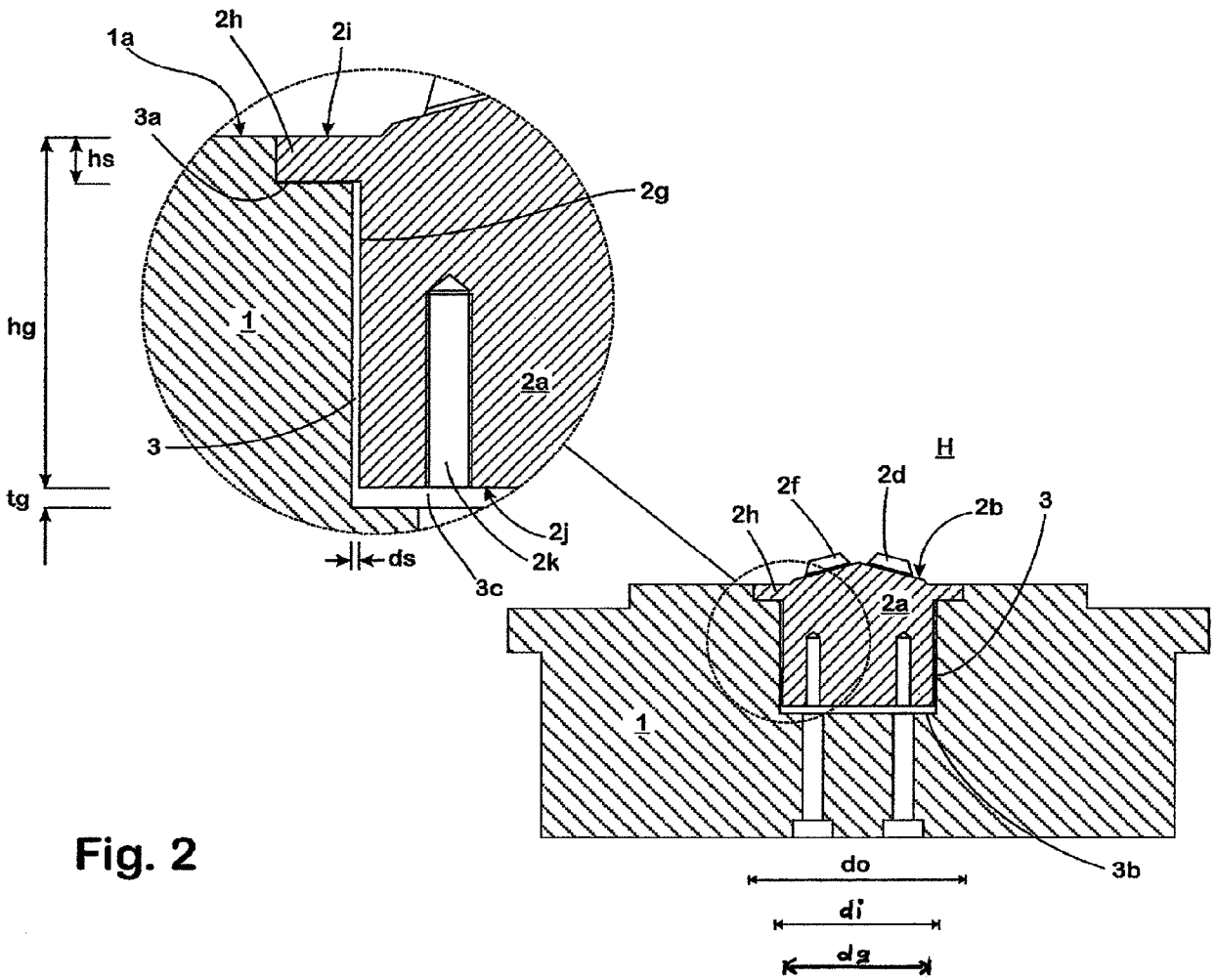

The invention will be described in more detail below with the aid of a drawing showing an embodiment. In the drawings, schematically:

FIG. 1 shows a cut-out of a mould body configured as a base plate of a permanent casting mould for casting a cylinder head, in plan view, FIG. 2 shows the mould body in a section along the section line A-A entered in FIG. 1.

DESCRIPTION

The mould body 1 is used as a base plate for a further casting mould, not shown, configured as a permanent casting mould, which surrounds the mould cavity H reproducing the respective mould part. The mould body 1, like the other mould bodies, not shown here, of the casting mould, is made of a heat-resistant tool steel, which in the German steel/iron list is allocated the material number 1.2343 and which contains (in weight %) 0.36 to 0.42% C, 0.90 to 1.20% Si, 0.30 to 0.50% Mn, ≦0.03% P, ≦0.03% S, 4.80 to 5.50% Cr, 1.10 to 1.40% Mo, 0.25 to 0.50% V and the remainder iron and unavoidable impurities. This tool steel has a coefficient of thermal expansion, which averages $11.5*10^{-6}$ m/(m*K).

In the casting mould composed of the base plate mould body 1 together with the other side walls, not shown here, and mould bodies forming a lid, cylinder heads are cast for internal-combustion engines. A number of combustion chambers corresponding to the number of cylinders of the respective internal-combustion engine and having valve seats for two respective inlet and two outlet valves is formed, in this case, in the cylinder heads. For this purpose, in the mould body 1, a number of casting mould inserts 2 corresponding to the number of cylinders of the respective internal-combustion engine are inserted into a respective receiver 3.

Each of the integrally configured casting mould inserts 2 has a cylindrical base body 2*a*, which on its side associated with the mould cavity H bears a surface 2*b* which is level in its annular peripheral portion and arched in its central middle portion in the direction of the mould cavity H, from which the shaped elements 2*c*, 2*d*, 2*e*, 2*f* reproducing the inlet and outlet valve seats project in pairs. Proceeding from the level peripheral section of the surface 2*b*, a support collar 2*h* projecting in the radial direction relative to the peripheral face 2*g* of the base body 2*a* is moulded onto the base body 2*a* and runs around the base body 2*a* and the surface 2*i* thereof associated with the mould cavity H is steplessly connected to the level peripheral section of the surface 2*b* of the base body 2*a*. The level hs of the support collar 2*h* is about 22% of the height hg of the base body 2*a*. Blind threaded bores 2*k* are formed into the base face 2*j* opposing the surface 2*b*, of the base body 2*a* of the casting mould insert 2, into which bores extension bolts, not shown here, can be introduced to fasten the casting mould insert 2 from its receiver 3.

The receiver 3 is formed into the mould body 1 in a pot shape and, in the region of its opening associated with the mould cavity H has an annularly peripheral shoulder 3*a* passing into the mould cavity H. The diameter do of the opening delimited by the inner peripheral face of the shoulder 3*a*, apart from a small undersize, corresponds to the external diameter of the support collar 2*h*, so the support collar 2*h* is held with a light press fit in the shoulder 3*a* when the casting mould is cold. At the same time, the depth of the shoulder 3*a* corresponds to the height hs of the support collar 2*h*, so, when the casting mould is cold, the surface 2*i* of the support collar 2*h* is aligned flush with the surface 1*a* of the mould body 1 delimiting the receiver 3.

Outside the shoulder 3*a*, the internal diameter di of the remaining portion of the receiver 3 is larger than the external diameter dg of the base body 2*a* of the casting mould insert 2 by an oversize ds, so the base body 2*a* is seated with play in the receiver 3 in the peripheral direction when the casting mould is cold. In the same way, the depth of the receiver 3 is greater by an oversize tg than the height hg of the base body 2*a*, so a free air space 3*c* is also formed between the base face 2*j* and the base 3*b* of the receiver when the casting mould is cold.

The casting mould inserts 2 inserted in the casting mould at least 95% by weight consist of Cu. Apart from the unavoidable impurities caused by production, the Cu material may, in a known manner, have further constituents, which are added thereto to improve certain properties. The casting mould inserts 2 manufactured from the Cu material composed in this manner on average have a coefficient of thermal expansion of $18*10^{-6}$ m/(m*K).

Accordingly, the combustion chamber inserts 2 expand over their height and width when heated considerably more than the mould body 1 manufactured from the steel material 1.2343. However, the proportion of the expansion of the casting mould insert 2 occurring over the height of the casting mould insert in the direction of the mould cavity H on heating, which has an effect on the position of the surface 2*b* provided with the shaped elements 2*c* to 2*f*, is small, as a change in position of the surface 2*b* only occurs proportionally to the height hs of the support collar 2*h*. The substantial part of the expansion in the height direction of the casting mould insert 2 is taken up by the air space 3*b* formed below the base body 2*a* in the receiver 3. In a corresponding manner, the expansion of the base body 2*a* in the radial width direction is taken up by the play which is present when the casting mould is cold between the inner peripheral wall of the receiver 3 and the outer peripheral face 2*g* of the base body 2*a*. In this manner, it is ensured that the expansion of the base body 2*a* in the receiver 3 is not hindered.

The height hs, taking into account the expansion behaviour of the mould body 1 and the casting mould insert 2, may be such that even with a (expansion) due to the contact with the light molten metal cast into the mould cavity H the surface 2*b* with the shaped elements 2*c* to 2*f* of the casting mould insert 2 is arranged at the same spacing from the surface 1*a* of the mould body 1 so a precise forming of the combustion chamber and the valve seats in the cylinder head to be produced is ensured.

LIST OF REFERENCE NUMERALS

1 mould body
2 casting mould insert
2*a* base body of the casting mould insert 2
2*b* surface of the casting mould insert associated with the mould cavity H
2*c* to 2*f* shaped elements reproducing inlet and outlet valve seats
2*g* peripheral face of the base body 2*a*
2*h* support collar
2*i* surface of the support collar associated with the mould cavity H
2*j* base face of the base body 2*a*
2*k* blind threaded bores
3 receiver
3*a* shoulder of the receiver 3
3*c* air space
dg external diameter of the base body 2*a*
di internal diameter of the receiver 3 outside the shoulder 3*a*
do diameter of the opening delimiting the inner peripheral face of the shoulder 3*a*
ds oversize
H mould cavity
hs height of the support collar 2*h*
hg height of the base body 2*a*
tg oversize of the depth of the receiver 3 relative to the height hg of the base body 2*a*

The invention claimed is:

1. Permanent casting mould for the casting of cast parts from a molten metal comprising at least one mould body, which at least partially surrounds a mould cavity reproducing the cast part to be cast and, in a wall of the at least one mould body which limits the mould cavity, a receiver is formed having a shoulder passing into the mould cavity and comprising a casting mould insert seated in the receiver, which has an upper side associated with the mould cavity surrounded by the respective permanent casting mould, a base body seated in the receiver with play when the casting mould is cold and a support collar which extends over a fraction of a height of the base body of the casting mould insert and is seated with positive fit in the shoulder of the receiver, a total height of the support collar and base body being smaller by an undersize, which is at least equal to a height dimension, by which the base body expands in a height direction during casting as a result of its heating occurring due to the contact with the molten metal, than the depth of the receiver, so a spacing is present between the base of the receiver and the side of the casting mould insert associated with it when the permanent casting mould is cold.

2. Permanent casting mould according to claim 1, wherein the support collar is seated in the shoulder of the receiver without play.

3. Permanent casting mould according to claim 1, wherein the support collar proceeds from the upper side of the casting mould insert associated with the mould cavity.

4. Permanent casting mould according to claim 1, wherein a height of the support collar is at most 30% of the height of the base body.

5. Permanent casting mould according to claim 4, wherein the height of the support collar is at most 15% of the height of the base body.

6. Permanent casting mould according to claim 1, wherein an undersize of the cross-section of the base body compared to the cross-section of the receiver is at least equal to the expansion, which occurs as a result of the heating of the casting mould insert on contact with the molten metal in the width direction of the base body.

7. Permanent casting mould according to claim 1, wherein the support collar extends around the base body.

8. Permanent casting mould according to claim 1, wherein the casting mould insert is manufactured from a material, the coefficient of thermal expansion of which differs from a material of the mould body.

9. Permanent casting mould according to claim 8, wherein the casting mould insert has a greater coefficient of thermal expansion than the material of the mould body.

10. Permanent casting mould according to claim 1, wherein the mould body is produced from a steel material.

11. Permanent casting mould according to claim 1, wherein the coefficient of thermal expansion of the material, from which the mould body is produced is $10*10^{-6}$ m/(m*K) to $14*10^{-6}$ m/(m*K).

* * * * *